United States Patent [19]

Tighe, Jr.

[11] Patent Number: 4,693,539

[45] Date of Patent: Sep. 15, 1987

[54] RIBBON COAX CABLE CONNECTOR

[75] Inventor: Charles I. Tighe, Jr., Hershey, Pa.

[73] Assignee: AMP Incorporated, Harrisburg, Pa.

[21] Appl. No.: 6,269

[22] Filed: Jan. 12, 1987

Related U.S. Application Data

[63] Continuation of Ser. No. 789,915, Oct. 17, 1985, abandoned, which is a continuation of Ser. No. 565,510, Dec. 27, 1983, abandoned.

[51] Int. Cl.[4] ..... H01R 13/58

[52] U.S. Cl. ..... 439/465; 439/404; 439/687; 439/752

[58] Field of Search ..... 339/14 R, 206 R, 206 P, 339/107, 103 R, 103 M, 105, 97 R, 97 P, 98, 99 R, 176 M, 210 R, 210 M, 211

[56] References Cited

U.S. PATENT DOCUMENTS

| | | | |
|---|---|---|---|
| 3,699,498 | 10/1972 | Hardesty | 339/107 |
| 3,864,010 | 2/1975 | Wasserlein | 339/107 |
| 3,879,099 | 4/1975 | Shaffer | 339/107 |
| 4,143,934 | 3/1979 | Siebert | 339/107 |
| 4,153,326 | 5/1979 | Frantz et al. | 339/99 R |
| 4,181,384 | 1/1980 | Dola et al. | 339/107 |
| 4,243,288 | 1/1981 | Lucius et al. | 339/107 |
| 4,342,494 | 8/1982 | Normann | 339/107 |
| 4,441,778 | 4/1984 | Sampson | 339/107 |
| 4,444,450 | 4/1984 | Haber | 339/107 |
| 4,519,659 | 5/1985 | Shiino et al. | 339/99 R |

FOREIGN PATENT DOCUMENTS

| | | |
|---|---|---|
| 0006100 | 1/1980 | European Pat. Off. . |
| 0018160 | 10/1980 | European Pat. Off. . |
| 2737328 | 2/1978 | Fed. Rep. of Germany . |

OTHER PUBLICATIONS

I.B.M. Technical Disclosure Bulletin (pp. 128, 1298), vol. 9, No. 10, Mar. 1967, by Dessauer and McNutt.

*Primary Examiner*—Gil Weidenfeld
*Assistant Examiner*—Thomas M. Kline

[57] ABSTRACT

An electrical connector for flat transmission cable comprises a body member having terminal-receiving passageways and conductor-receiving passageways with a continuous recess between the terminal-receiving passageways and the conductor-receiving passageways. Electrical terminals are disposed in the terminal-receiving passageways for terminating electrical conductors of a flat transmission cable which are disposed in respective conductor-receiving passageways. Cover members are secured onto the body member and they include projection members engaging the respective electrical conductors in the continuous recess to provide strain relief for the conductors. According to another aspect of the present invention, the cover members include projections that are disposed on each side of the conductor-receiving sections of the electrical terminals to prevent the electrical conductors from disconnecting from the conductor-receiving sections.

9 Claims, 7 Drawing Figures

RIBBON COAX CABLE CONNECTOR

This application is a continuation of application Ser. No. 789,915 filed Oct. 7, 1985, now abandoned, which is a continuation of application Ser. No. 565,510 filed Dec. 27, 1983, now abandoned.

FIELD OF THE INVENTION

This invention relates to electrical connectors and more particularly to electrical connectors for connection with the conductors of ribbon coax cable.

BACKGROUND OF THE INVENTION

Terminated ribbon coax cable assemblies are used to electrically connect electronic circuits of electronic equipment together. These cable assemblies are bent and twisted thereby subjecting them to stresses which cause the signal and drain conductors of the ribbon coax cable to move relative to one another which can result in breakage of one or some of the conductors at the termination sections of the electrical terminals thereby resulting in open circuits which can be difficult to locate. Moreover, after a length of ribbon coax cable has been removed from a roll of cable and its ends have been terminated in electrical connectors, the cable undergoes relaxation whereby more of the exposed ends of the conductor are exposed and these exposed ends can move relative to one another which can cause shorting of conductors within the connectors.

U.S. Pat. No. 4,444,450, the disclosure of which is incorporated herein by reference, discloses a connector which includes a dielectric body member having conductor-receiving passageways along which signal and drain conductors of a ribbon coax cable respectively extend with ends of these conductors being terminated within termination sections of electrical terminals in the body member. Each conductor-receiving passageway has a recess therein which receives a respective projection from a cover member that is secured onto the body member. The projections engage and deform the conductors into the recesses thereby providing strain relief for the conductors.

It has been found that the projections have not provided the desired strain relief on the conductors when the cover members are secured on the body member, because the projections are small and they vary in size as a result of tolerance factors such that they are not able to deform the conductors into the recesses to provide the necessary strain relief thereon. This enables the conductors to therefore move in the conductor-receiving passageways and places stress on the terminations that can result in failure of some of the terminations.

SUMMARY OF THE INVENTION

According to the present invention, an electrical connector for flat transmission cable comprises a body member having terminal-receiving passageways and conductor-receiving passageways. Continuous recesses are located in the body member between the terminal-receiving passageways and the conductor-receiving passageways. Electrical terminals are disposed in the terminal-receiving passageways for terminating electrical conductors of a flat transmission cable which are disposed in respective conductor-receiving passageways and extend across the continuous recesses. Cover members are secured onto the body member and they include projections that extend into respective continuous recesses engaging the conductors therein thereby providing a strain relief for the conductors.

According to another aspect of the present invention, the cover members include projections that are disposed on each side of the conductor-receiving sections of the electrical terminals to prevent the electrical conductors from disconnecting from the conductor-receiving sections.

According to a further aspect of the present invention, the cover members have strain relief members engaging the cable.

DETAILED DESCRIPTION OF PREFERRED EMBODIMENTS

Figure 1:
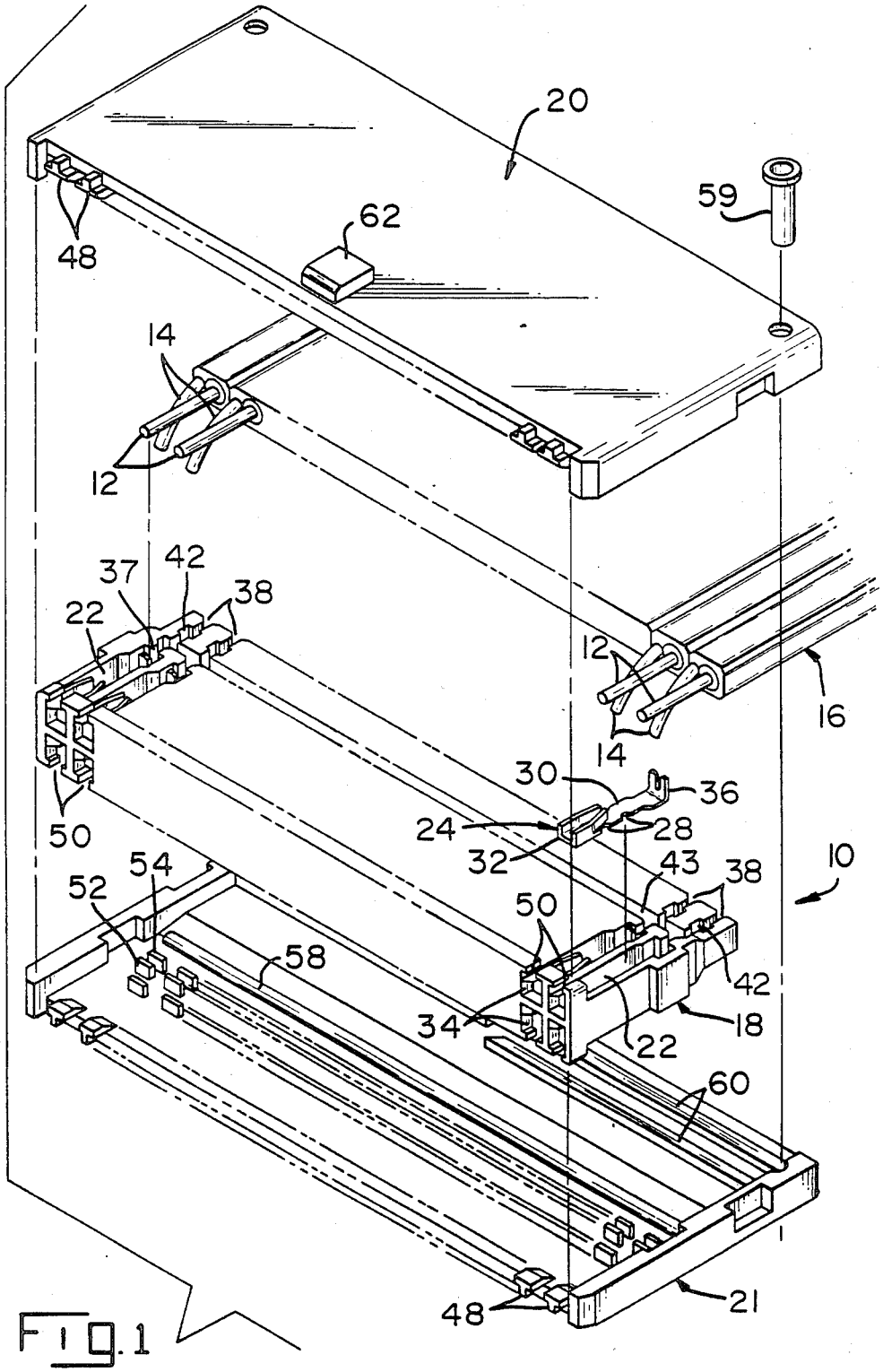
FIG. 1 is a perspective exploded view of parts of the electrical connector.

FIGS. 1–4 and 7 illustrate a ribbon coax cable connector 10 for terminating signal conductors 12 and drain conductors 14 of flat transmission or ribbon coax cable 16 which is disclosed in U.S. Pat. No. 3,775,552, the disclosure of which is hereby incorporated herein by reference. While ribbon coax cable is being used, other types of ribbon cable having signal and drain conductors can be used. Connector 10 comprises a body member 18 and cover members 20, 21 which are molded from a suitable plastic material.

Body member 18 includes a series of terminal-receiving passageways 22 on each side thereof and in which electrical terminals 24 are disposed. Each passageway 22 includes projections 26, 27 in opposing surfaces which mate with corresponding recesses 28 in a body section 30 of terminals 24 to properly position electrical terminals 24 within passageways 22. Projections 27 are deformed onto body sections 30 to stake terminals 24 in position in passageways 22. A post-engaging section 32 of electrical terminal 24 is in alignment with a beveled opening 34 at the front end of body member 18. A conductor-terminating section 36 of terminal 24 is in alignment with a slot 37 in body member 18 and with a respective conductor-receiving passageway 38 in which conductors 12 or 14 are positioned for electrical termination with conductor-terminating section 36. Slots 37 and conductor-receiving passageways 38 are beveled at their entrances to facilitate the positioning of conductors 13, 14 therein. Sloped surfaces 40 are located on each side of body member 18 along passageways 38. Recesses 42 are disposed in each side of passageways 38 and they extend to the bottom surfaces of passageways 38. A continuous arcuate recess 43 is located in each side of body member 18 between slots 37 and passageways 38 as shown in FIGS. 1–4. Arcuate recesses 43 extend below the highest level of slots 37 and sloped surfaces 40. As shown in FIG. 4, passageways 38 on one side of body member 18 are offset with respect to the passageways 38 in the other side of body member 18 so that the inner end of body member 18 has a square wave configuration.

Thus, cable 16 is stripped baring only conductors 12, 14 as shown in FIGS. 1–4 which are then positioned within respective passageways 38, they extend across continuous receses 43 into slots 37, conductors 12, 14 are then deformed into respective recesses 43 and then terminated in conductor-terminating sections 36 of electrical terminals 24 in accordance with conventional terminating practices. It is also imperative that the end of cable 16 be in engagement with the inner end of body member 18 after conductors 12, 14 have been terminated in conductor-terminating sections 36 to prevent migration of conductors 12, 14 that can short with one another. Thereafter, cover members 20, 21 are secured in place on body member 18.

Figure 2:
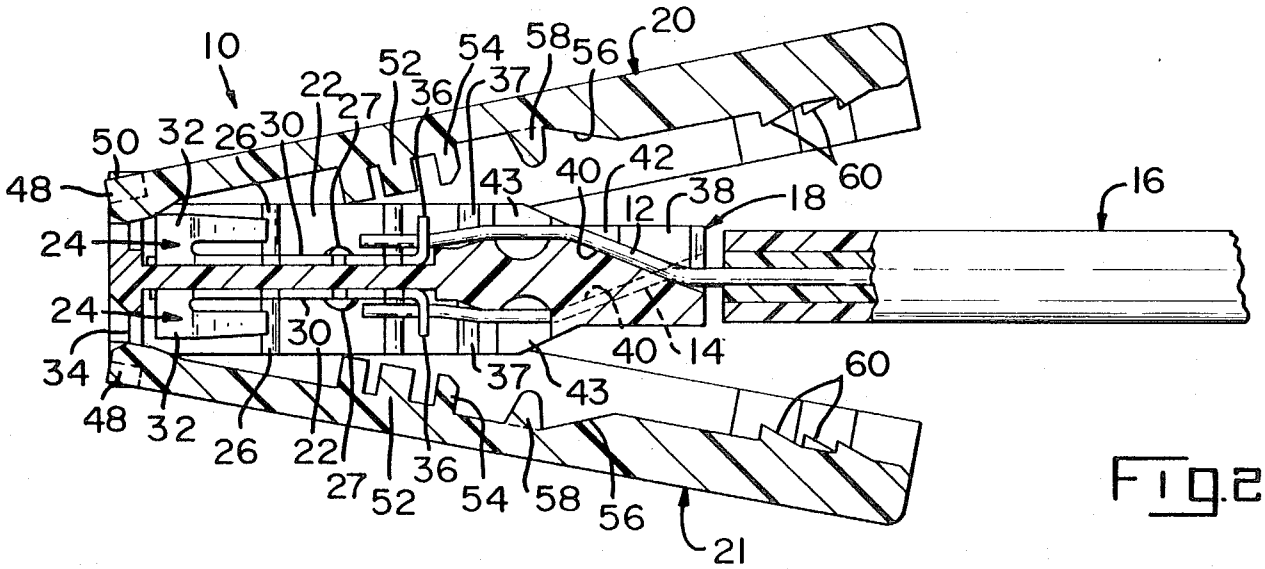
FIG. 2 is a cross-sectional view showing the electrical conductors of the flat transmission cable terminated to the electrical terminals and the cover members in a partly-closed position.
Figure 3:
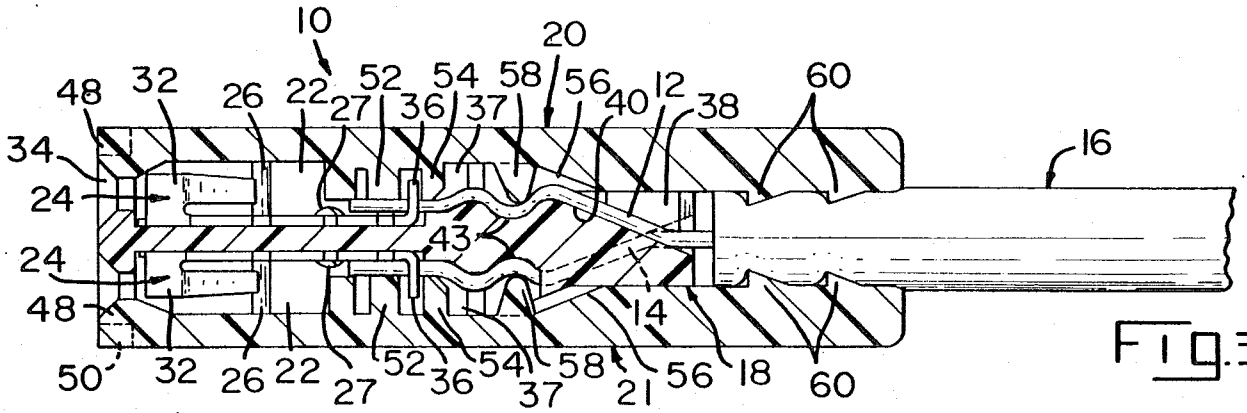
FIG. 3 is a view similar to FIG. 2 showing the cover members in a closed position.
Figure 4:
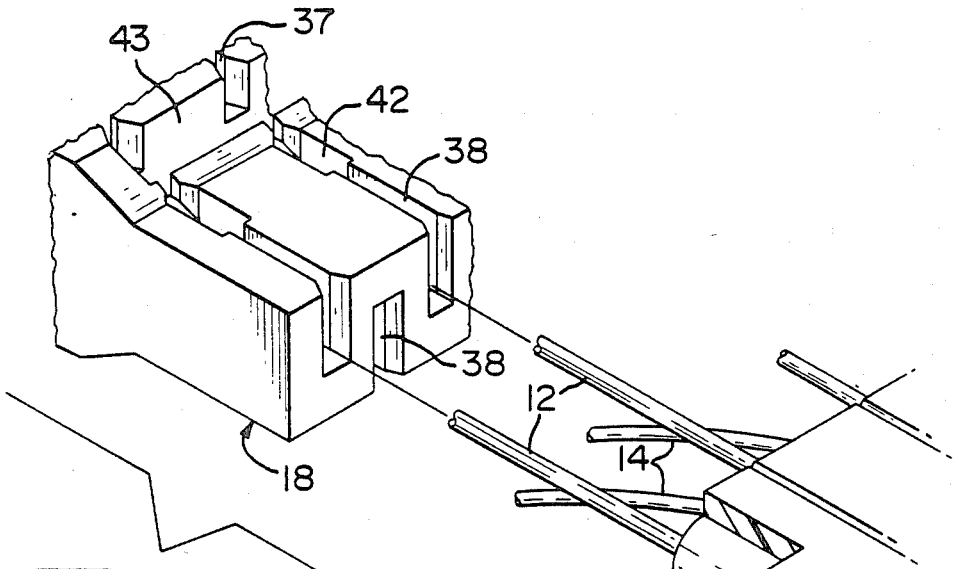
FIG. 4 is an exploded perspective view of part of a body member and a ribbon coax cable.

Each of cover members 20, 21 has T-shaped sections 48 at the front end thereof which are disposed in respective passageways 22 and matable within recesses 50 as shown in FIGS. 2 and 3. Sections 48 complete the outer ends of beveled openings 34 and define pivots about which cover members 20, 21 move when being positioned onto body member 18. Spaced projections 52, 54 extend inwardly from the inside surface of cover members 20, 21 and they are disposed on each side of respective conductor-terminating sections 36 when the cover members are secured in position on body member 18 to maintain conductors 12, 14 in position in conductor-terminating sections 36. Beveled surfaces 56 of cover members 20, 21 extend along sloped conductors 12, 14 and arcuate projections 58 engage conductors 12, 14 maintaining them into arcuate recesses 43 when cover members 20, 21 are secured in position on body member 18 by rivets 59 thereby defining a strain relief for conductors 12, 14 to maintain them in position in passageways 38 and recesses 42 and in a terminated position within conductor-terminating sections 36 when stresses and strain occur as a result of temperature variations or during the handling of cable 16. Projections 52, 54 also maintain conductors 12, 14 within conductor-terminating sections 36.

The continuous form of recesses 43 and projections 58 serve to apply pressure on conductors 12, 14 to maintain them in passageways 38 and terminated in terminating sections 36 of terminals 24 so that they do not move out of the passageways and short one another. If conductors 12, 14 do expand or move because of temperature variation or excess twisting of the cable, part of the conductors 12, 14 can move into recesses 42 to accommodate the movement of the conductors. The continuous form of projections 58 provides a stronger projection for maintaining conductors 12 and 14 in arcuate recesses 43.

Figure 7:
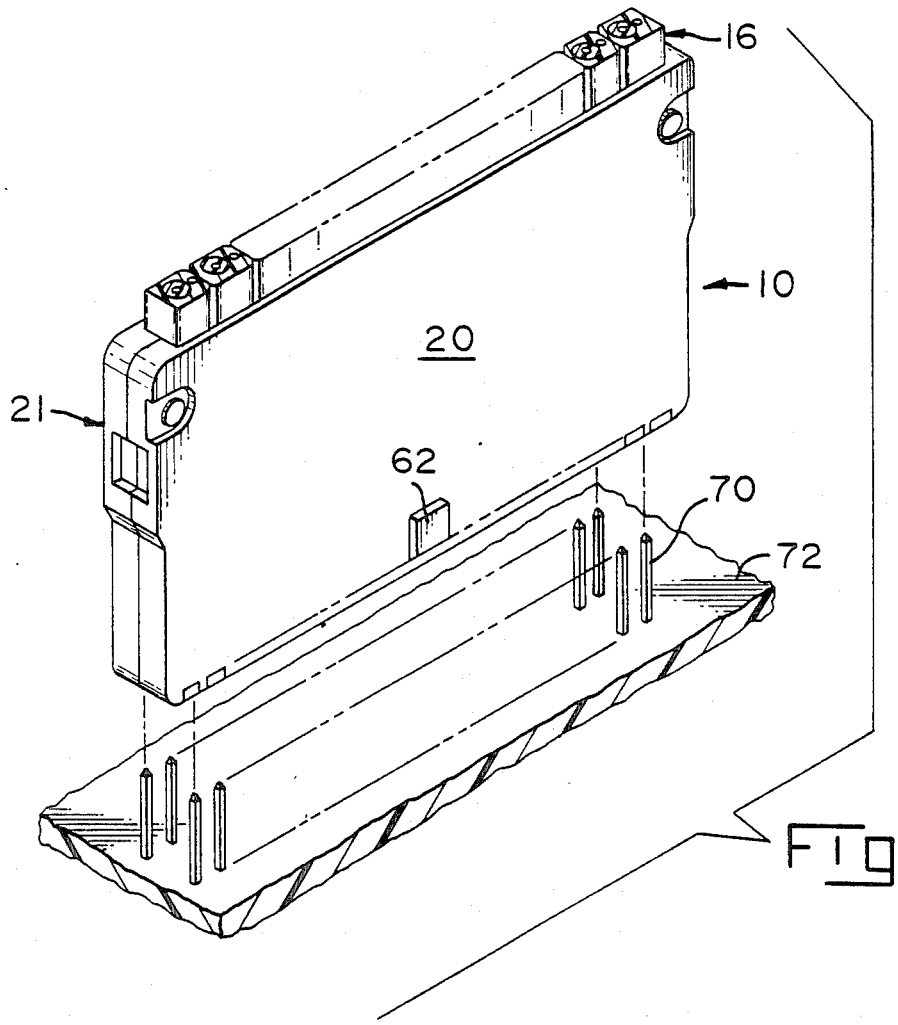
FIG. 7 is a perspective view of the terminated electrical connector exploded from the pins on a printed circuit board intended for connection therewith.

Wedge-shaped strain relief members 60 which are located on cover members 20, 21 engage cable 16 when cover members 20, 21 are secured onto body member 18 via rivets 59 thereby forming a strain relief when stresses and strains are applied to cable 16. Thus, projections 58 engaging conductors 12, 14 in respective recesses 43 in conjunction with strain relief members 60 engaging cable 16 function together to maintain conductors 12, 14 within conductor-receiving passageways 38 therefore controlling conductor migration and preventing stresses on the terminations of conductors 12, 14 in conductor-terminating sections 36. Connector 10 is inserted onto posts 70 positioned on printed circuit board 72 or removed therefrom as shown in FIG. 7 or matable electrical connectors 10 are connected together within a housing member (not shown).

Cover member 20 of connector 10 is provided with projection 62 of which the leading edge is beveled and is a polarizing member for matable engagement within a recess of a housing member.

Figure 5:
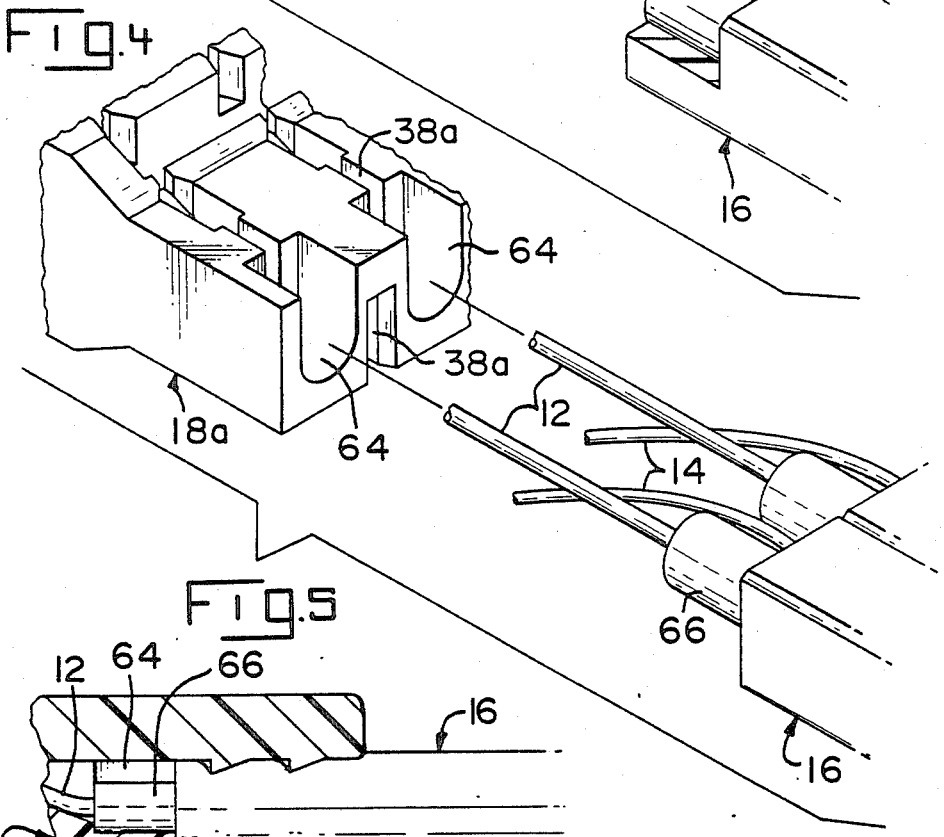
FIG. 5 is a view similar to FIG. 4 of an alternative embodiment.
Figure 6:
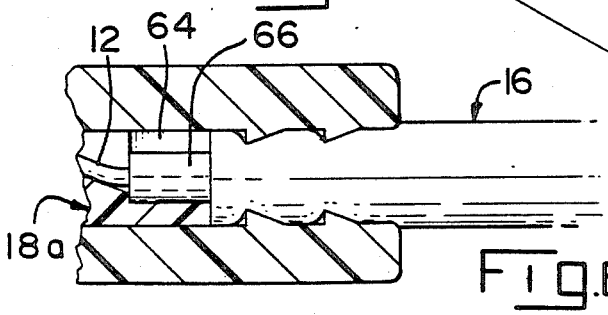
FIG. 6 is a part cross-sectional view of FIG. 5 with the cover members in position.

FIGS. 5 and 6 illustrate an alternative embodiment of body member **18*a* which is provided with arcuate recesses 64 as part of conductor-receiving passageways 38*a* on one side of body member 18*a* to receive therein an exposed end of insulation sheath 66 surrounding signal conductors 12 of cable 16 as shown in FIG. 6. Passageways 38*a* on the other side of body member 18*a* have the same configuration as passageways 38 of body member 18. Migration of conductors 14 in this embodiment will not short with conductors 12 because of insulation sheath 66 covering conductors 12 and being disposed within recesses 64**.

I claim:

1. An electrical connector for a transmission cable comprising;

a body of insulative material, conductor receiving passageways having a bottom wall and sidewalls extending along the body for snugly receiving corresponding electrical conductors of the transmission cable therealong, terminal receiving passageways extending along the body and aligned with corresponding conductor receiving passageways, conductive electrical terminals in the terminal receiving passageways having conductor terminating section means for electrical connection with corresponding electrical conductors of the transmission cable, cover means for securing onto said body and covering the terminal receiving passageways and the conductor receiving passageways, conductor strain relief means on said cover means for maintaining said conductor terminating section means connected with corresponding electrical conductors of the transmission cable, cable strain relief means for engaging the transmission cable, and conductor receiving recess means in the sidewalls of the conductor receiving passageways between said conductor strain relief means and said cable strain relief means to accommodate movement of conductors received in said conductor receiving passageways because of temperature variation or twisting of the transmission cable that includes said conductors received in said conductor receiving passageways.

2. An electrical connector as recited in claim 1 wherein, insulation receiving means are located at an inner end of said body in alignment with said conductor receiving passageways for receiving insulation of the transmission cable.

3. An electrical connector as recited in claim 1 wherein, said cover means include projection means cooperating with strain relief recess means in said body for engaging and urging portions of conductors, received in said conductor receiving passageways to curve laterally of their axes and into said strain relief recess means.

4. An electrical connector as recited in claim 1 wherein, said conductor strain relief means comprise projection means extending from said cover means for overlapping opposite sides of said termination section means and for urging corresponding conductors in the terminating section means.

5. An electrical connector as recited in claim 1 wherein, a first set of said conductor receiving pasageways extend along a first side of said body, and a second set of said conductor receiving passageways extend along a second side of said body.

6. An electrical connector as recited in claim 2 wherein, a first set of said conductor receiving passageways extend along a first side of said body, and a second set of said conductor receiving passageways extend along a second side of said body together with said insulation receiving means.

7. An electrical connector as recited in claim 3, 4 or 5 wherein, insulation receiving means are located at an inner end of said body, in alignment with said conductor receiving passageways for receiving insulation of a transmission cable.

8. An electrical connector as recited in claim 4, 5 or 6 wherein, said cover means include projection means cooperating with strain relief recess means in said body for engaging and urging portions of conductors received in said conductor receiving passageways to curve laterally of their axes and into said strain relief recess means.

9. An electrical connector as recited in claim 5 or 6 wherein, said conductor strain relief means comprises projection means extending from said cover means for overlapping opposite sides of said terminating section means and for maintaining corresponding conductors in the terminating section means.

* * * * *